US008807031B2

(12) United States Patent
Styles et al.

(10) Patent No.: US 8,807,031 B2
(45) **Date of Patent: *Aug. 19, 2014**

(54) PRINTER PALLET FOR FLAT PRINTING OF MULTIPLE TARGET IMAGE AREAS ON 3-DIMENSIONAL OBJECT

(71) Applicant: Vistaprint Schweiz GmbH, Winterthur (CH)

(72) Inventors: Jonathan D. Styles, Northville, MI (US); Barry M. Parent, Lasalle (CA); Michael K. Gospodorz, Winterthur (CH); Heike Hafke, Venlo (NL)

(73) Assignee: Vistaprint Schweiz GmbH, Winterthur (CH)

( * ) Notice: Subject to any disclaimer, the term of this patent is extended or adjusted under 35 U.S.C. 154(b) by 4 days.

This patent is subject to a terminal disclaimer.

(21) Appl. No.: 13/761,961

(22) Filed: Feb. 7, 2013

(65) Prior Publication Data

US 2013/0213251 A1 Aug. 22, 2013

Related U.S. Application Data

(60) Continuation of application No. 12/848,537, filed on Aug. 2, 2010, now abandoned, and a continuation-in-part of application No. 13/184,782, filed on Jul. 18, 2011, now Pat. No. 8,371,220, which is a division of application No. 12/020,933, filed on Jan. 28, 2008, now Pat. No. 7,980,177.

(51) Int. Cl.
*B41F 17/38* (2006.01)

(52) U.S. Cl.
CPC ..... *B41F 17/38* (2013.01)
USPC ..... 101/483; 101/41; 101/474; 101/126

(58) Field of Classification Search
USPC ..... 101/4, 41, 42, 407.1, 474, 483
See application file for complete search history.

(56) References Cited

U.S. PATENT DOCUMENTS

| | | | |
|---|---|---|---|
| 1,401,570 | A | 12/1921 | Turner |
| 4,266,476 | A | 5/1981 | Maloof |
| 4,612,856 | A | 9/1986 | Jennings |
| 4,670,084 | A | 6/1987 | Durand |
| 4,708,057 | A | 11/1987 | Hogenson |
| 4,753,161 | A | 6/1988 | Kimball |
| RE32,731 | E | 8/1988 | Jennings et al. |
| 4,901,638 | A | 2/1990 | Jennings |
| 5,014,614 | A | 5/1991 | Thieme |
| 5,094,160 | A | 3/1992 | Jennings |
| 5,123,345 | A | 6/1992 | Wood |
| 5,218,908 | A | 6/1993 | Whitfield |
| 5,490,456 | A | 2/1996 | Richardson et al. |
| 6,775,934 | B1 | 8/2004 | Gallik et al. |
| 7,191,702 | B2 | 3/2007 | Kercher |
| 7,413,301 | B2 | 8/2008 | Niimi et al. |
| 7,710,442 | B2 | 5/2010 | Lyons et al. |
| 7,765,927 | B1 | 8/2010 | Liu et al. |
| 7,980,177 | B2 | 7/2011 | Styles et al. |
| 8,371,220 | B2 | 2/2013 | Styles et al. |

(Continued)

FOREIGN PATENT DOCUMENTS

| | | |
|---|---|---|
| GB | 1429563 | 3/1976 |
| WO | 2012/018467 | 2/2012 |

*Primary Examiner* — David Banh
(74) *Attorney, Agent, or Firm* — Jessica Costa

(57) ABSTRACT

Pallets for flat-printing multiple areas of a 3-dimensional object, especially in a single print job as received by the printing system, and methods for printing the same.

14 Claims, 13 Drawing Sheets

(56) References Cited

U.S. PATENT DOCUMENTS

| | | | |
|---|---|---|---|
| 2002/0131062 | A1 | 9/2002 | Neri et al. |
| 2007/0211132 | A1 | 9/2007 | Lyons et al. |
| 2008/0297584 | A1 | 12/2008 | Lyons et al. |
| 2009/0188404 | A1 | 7/2009 | Styles et al. |
| 2009/0262172 | A1 | 10/2009 | Silverbrook |
| 2012/0024176 | A1 | 2/2012 | Styles et al. |

PRINTER PALLET FOR FLAT PRINTING OF MULTIPLE TARGET IMAGE AREAS ON 3-DIMENSIONAL OBJECT

RELATED APPLICATIONS

This application is a continuation of U.S. application Ser. No. 12/848,537, filed Aug. 2, 2010, and is a continuation-in-part of U.S. application Ser. No. 13/184,782, filed on Jul. 18, 2011, issuing on Feb. 12, 2013 as U.S. Pat. No. 8,371,220, which is a divisional of U.S. application Ser. No. 12/020,933, filed Jan. 28, 2008, issued as U.S. Pat. No. 7,980,177 on Jul. 19, 2011, each of which is incorporated herein by reference in its entirety.

FIELD OF THE INVENTION

This invention relates to printing images on apparel, and more particularly to a novel pallet for flat printing of multiple images on 3-dimensional objects.

BACKGROUND OF THE INVENTION

Direct printing of images or graphic designs onto apparel such as t-shirts and hats is now commonplace. Printing presses and digital printers are typically designed for printing on flat surfaces. Apparel such as t-shirts, which can be easily positioned to lie flat, conform naturally to these types of pallets. However, for items of apparel such as baseball caps that are inherently 3-dimensional even when laying on a flat surface, these types of pallets can be problematic as the fabric which may be gathered or otherwise constructed to form a 3-dimensional shape needs to be stretched out flat and held taut in order to print thereon. Furthermore, in order to print on both the front and back side of a 3-dimensional object such as a hat, in previous techniques the front side of the hat had to be printed separately from the back side of the hat. Accordingly, a need exists for a pallet which allows flat printing of multiple areas on a 3-dimensional object in a single print job.

SUMMARY

Embodiments of the invention are directed at printer pallets for flat printing of multiple target image areas on 3-dimensional objects. In a specific applications, printer pallets are designed for flat printing systems which support and position hats, such as baseball caps, to allow multiple areas of the hat, such as the front and back sides of the hat, to be printed as a single print job by the flat printing system.

In accordance with one embodiment of the invention, a pallet for holding a 3-dimensional object for printing onto a plurality of target image areas on a flexible 3-dimensional object includes a bottom plate supporting at least one print station. Each print station is configured with a plurality of platens mounted on the bottom plate, the plurality of platens having respective flat top surfaces and positioned to support the target print areas of the 3-dimensional object when the 3-dimensional object is properly positioned in the pallet, a top plate movable between an open position and a closed position, the top plate comprising a plurality of openings positioned to expose at least a portion of each of the flat top surfaces of the plurality of platens when the top plate is in the closed position and the pallet is empty, and to expose the target image areas of the flexible substrate of the 3-dimensional object when the 3-dimensional object is properly positioned in the pallet and the top plate is moved into the closed position, and one or more compression distributors attached to the top plate and positioned to engage the flexible substrate of the 3-dimensional object and to pull the engaged flexible substrate towards the bottom plate as the top plate is moved from the open position and lowered onto the bottom plate to the closed position to thereby pull taut the portions of the flexible substrate corresponding to the plurality of target image areas over the plurality of platens.

In accordance with another embodiment of the invention, the pallet of the previous paragraph includes a flat-substrate platen having a contiguous flat surface area sized to accommodate at least a substrate having a size that corresponds to the maximum printable area of the printing system in which the pallet operates, or at least a standard paper size accepted by and printable by the printing system. The flat-substrate platen may be form integral to the pallet, or may be a removable component of the pallet.

In accordance with yet another embodiment, a method for flat printing on multiple image areas of a 3-dimensional object includes mounting a 3-dimensional object in a pallet, the pallet exposing multiple targeted printing areas of the 3-dimensional object such that each exposed targeted printing area is flat and taut and mounting the pallet in a flat-printing system, the flat-printing system receiving a print job containing a plurality of images each corresponding to a different one of the exposed targeted printing area and printing the respective plurality of images onto the corresponding exposed targeted printing areas of the 3-dimensional object mounted on the pallet.

It is an advantage of the invention that the bill of the hat is fully supported and the fabric of multiple areas of the cap to be printed is held flat and taut for printing.

It is an advantage of the invention that multiple images can be printed on multiple areas of the 3-dimensional object in a single print job and that the 3-dimensional object need not be loaded onto different pallets or repositioned on the same pallet between printing different areas on the 3-dimensional object.

These and other objects, features and advantages of the invention will be better understood with reference to the accompanying drawings, description and claims.

DETAILED DESCRIPTION

It will be understood that, while the discussion herein describes pallets for flat printing of the front and back sides of baseball caps, it will be understood that the invention is not so limited and is relevant to any pallet for printing multiple areas of a 3-dimensional object along a flat plane, especially in a single print job as received by the printing system.

Figure 1A:
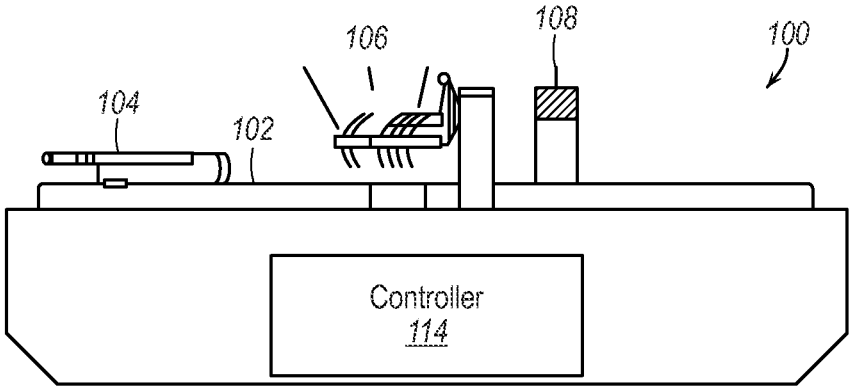
FIG. 1A is a side view of a digital image printer for printing digital images directly onto apparel.
Figure 1B:
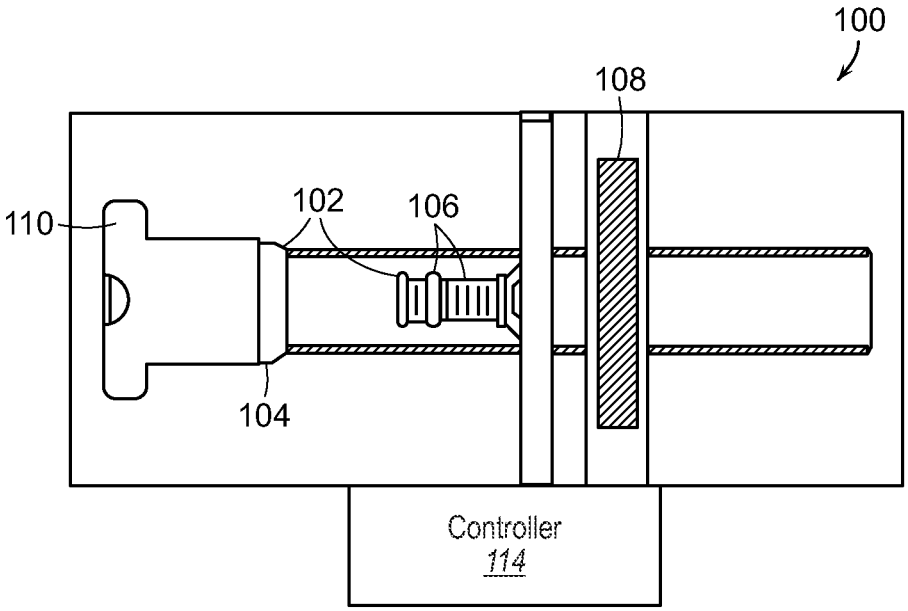
FIG. 1B is a top view of the digital image printer of FIG. 1A.

FIGS. 1A and 1B illustrate a digital image printer 100 for printing digital images directly onto apparel such as t-shirts and hats. The printer 100 includes a printing table 102 having a pallet 104 mounted thereon fir holding an apparel piece 110. The printer 100 also includes an array of print heads or ink nozzles 106 and a curing unit 108. The printing table 102 is mounted on a conveyance system 112 which conveys the printing table 102 along a pre-determined path past the operative ends of the print heads 106 and the curing unit 108. The conveyance system 112 may be any automated or manual means for conveying the printing table 102 along the predetermined path. For example, in one embodiment, the conveyance system 112 is an automated conveyor belt system under the control of a controller 114. In another embodiment, the conveyance system 112 is a set of rollers over which the printing table slides when manually guided by a human operator.

A controller 114 is coupled to the printer 100 for causing printing of one or more digital images on the apparel piece 110 on the pallet 104 as the printing table 102 passes the print heads 106. For a color image, the printing of the images is achieved by placing ink drops at different adjacent sites as discreet, physically non-mixed drops. The ink composition used must prevent the drops from "bleeding" on the applied media. In the illustrated embodiment, the image is printed by an array of color printing heads 106 each comprising a plurality of ink nozzles containing ink of the head's respective color ink. The image is printed using subtractive primary colors: Cyan, Yellow, Magenta, and Black (CYMK), for example, using transparent ink. When printing on dark colored apparel, a layer of white ink may first be printed prior to printing the CYMK process. The printing of a single print job containing one or more images to be printed on respective one or more targeted print areas on the apparel piece 110 may require a single pass, or series of passes, to complete the printing of the image(s) on the apparel piece 110. After the printing process is complete, the controller 114 causes the printing table 102 to convey the apparel piece 110 on the pallet 104 past the curing unit 108 to cure the ink on the apparel piece 110. The curing may require a single pass, or series of passes, to complete the curing of the ink.

The curing unit 108 cures ink deposited by the printing heads 106 on the apparel piece 110 on the table, although, alternatively, the ink could be allowed to dry and cure by itself with time. During the printing process, the each layer of the image is cured and fixed by a curing unit 108 to prevent its dissolution with the next masking layer. This can be accomplished in any conventional manner, such as UV curing lamp, IR, hot air, etc., depending on the specific ink type and application.

Figure 2A:
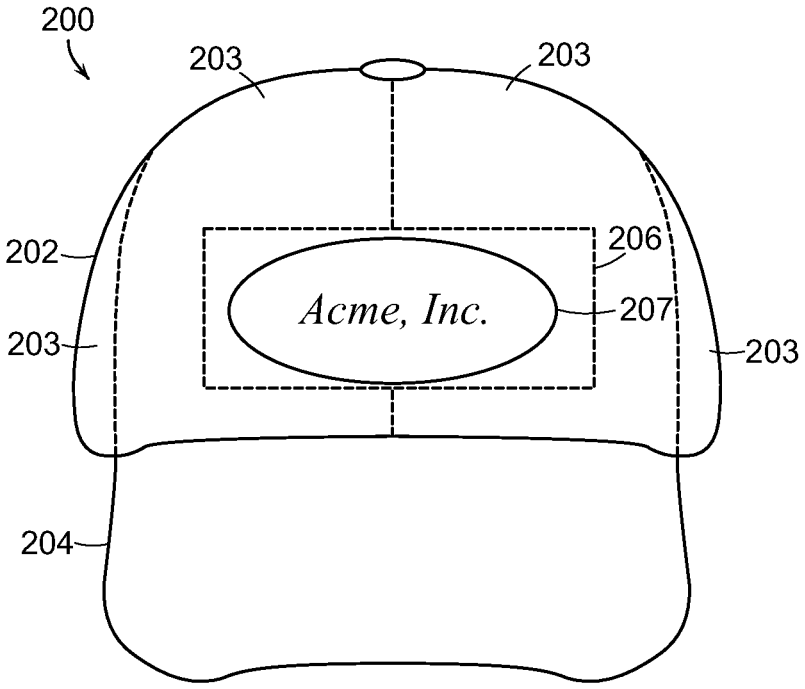
FIG. 2A is a front view of a traditional baseball cap.
Figure 2B:
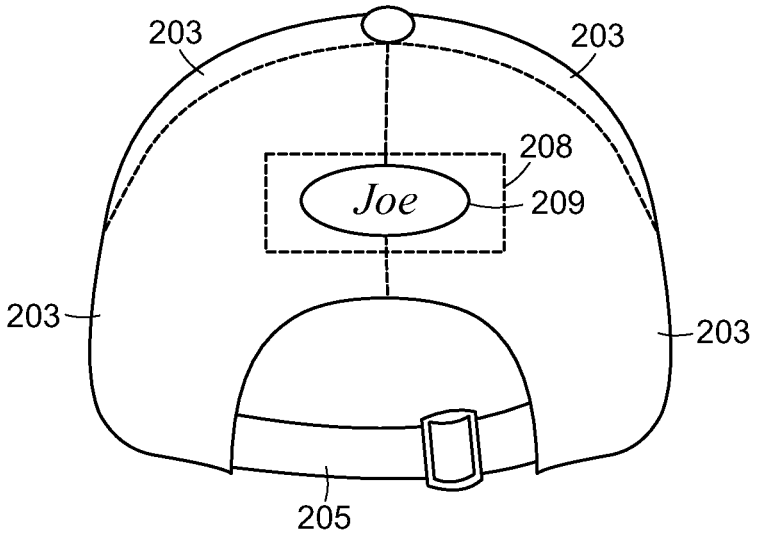
FIG. 2B is a rear view of a traditional baseball cap.

FIGS. 2A and 2B depict a standard baseball cap 200. As shown, the baseball cap 200 includes a 3-dimensional cap 202, for example made of fabric or other flexible substrate material (hereinafter referred to simply as "fabric"), with a bill 204 in the form of a long, stiffened and curved peak. The cap 202 may be fitted. Alternatively, the back of the cap 202, shown in FIG. 2B, may include an adjustor strap 205 made from plastic, Velcro, or elastic, so that it can be quickly adjusted to fit the size of the head of the wearer. The cap 202 is generally a hemispherical shape wherein the 3-dimensional curves are achieved by sewing a plurality of sections 203 together. Since the bill 204 is traditionally worn over the eyes, a printed image 207 is typically printed in a printable image area 206 on the front side of the cap 202 above the bill 204, as illustrated in FIG. 2A. In the illustrative embodiment, an image 209 may also be printed on the rear of the cap, for example in the printable image area 208 on the fabric of the cap 202 positioned above the adjustor strap 205, as illustrated in FIG. 2B. While embodiments described hereinafter show a hat pallet for printing on the fabric of the cap 202 above the bill 204 and above the adjustor strap 205, it is to be understood that the hat pallet may be modified to print images on other areas of the cap 202, for example the top or the sides, while still securing the bill during printing.

FIGS. 3A-3D together illustrate an exemplary embodiment of a novel single-hat-station pallet 300 for fiat printing by a flat printing system on the front and back sides of a hat in the form of a baseball cap 200, such as that shown in FIGS. 2A and 2B. The pallet 300 includes a hat station 310 and may be mounted on the printing table 102 in a flat printing system 100 such as that shown in FIGS. 1A and 1B and used to flat print one or more images 207, 209 on one or more of a front printable image area 206 and a back printable image area 208 of the cap 202.

Figure 3A:
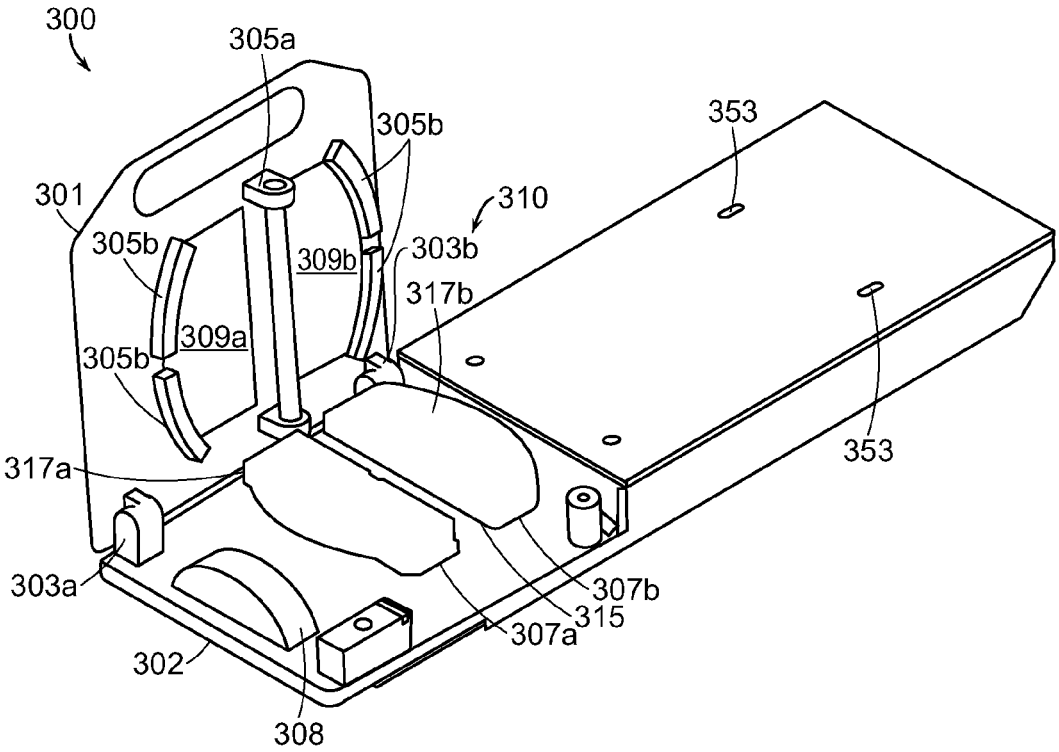
FIG. 3A is a perspective view of an exemplary embodiment of a hat pallet with the top plate open.
Figure 3B:
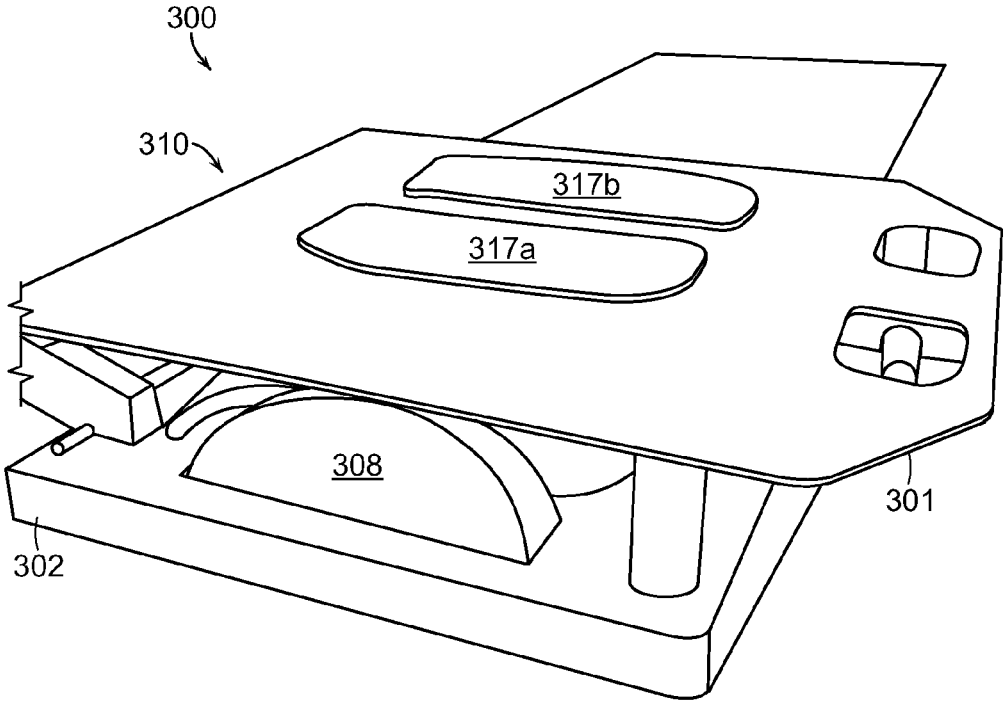
FIG. 3B is a perspective view of the hat pallet of FIG. 3A with the top plate closed.

As illustrated in FIGS. 3A and 3B, the pallet 300 includes a top plate 301 hingeably mounted by hinges 303*a*, 303*b* to a bottom plate 302. The top plate 301 may be moved between an open position, shown in FIG. 3A, and a closed position, shown in FIG. 3B. In an embodiment, the top plate 301 is hingeably mounted by hinges 303*a*, 303*b* to a bottom plate 302 and is in the closed position when the top plate 301 is rotated down over the bottom plate 302 such that the top plate 301 and bottom plate 302 form substantially parallel planes. The top plate 301 may be held securely over the bottom plate 302 by a locking or clamping mechanism 313 when the top plate 301 is in the closed position to provide compressive force on areas of the hat (discussed hereinafter) when a hat is mounted in the pallet. In one embodiment, the locking mechanism (not shown) is a magnetic latch comprising a magnet mounted on the top side of the bottom plate 302 and a matching magnet mounted in corresponding position on the underside of the top plate 301 such that the magnets on the top and bottom plates attract and compress the plates together. Alternatively, the locking mechanism may be implemented using any type of mechanical latch.

The hat station 310 generally includes each of a first platen 307*a* and a second platen 307*b* is mounted on the bottom plate 302. During operation, the top surfaces of the platens 307*a*, 307*b* engage the underside of the targeted printing areas of the cap 200 on which the image(s) is/are to be printed. The first platen 307*a* is preferably configured with a curved edge that follows the curve of the cap 202 along the bill 204 attachment, while the second platen 307*b* is configured with a curved edge that follows the curve of the cap 202 along the back side of the cap 202. The curved edges of the platens 307*a*, 307*b* allow printing closer to the edges of the front and back of the cap 202.

A bill support 308, in one embodiment formed of a semi-circular block 308, is mounted on the bottom plate 302. The bill support 308 preferably substantially conforms to the shape and curve of the bill 204 of the baseball cap 200. The bill support 308 also is preferably shaped to allow the hat to be positioned in the hat station 310 of the pallet in a manner whereby the bill 204 and fabric of the cap 202 above the bill 204 lie along a substantially horizontal plane. The bill support 308 is positioned close enough to the bottom edge (where the bottom edge of the image will be printed) of the first platen 307*a* so as to allow printing in the image area 206 on the cap 202 within a centimeter or less (or more, if desired) of the edge of the cap 202 where is attached, to, and abuts, the bill 204. In one embodiment, the bill support 308 is positioned such that, when a baseball cap 200 is mounted in the hat station 310 of the pallet 300, the bill 204 of the baseball cap 200 is fully supported by the bill support 308 and an image 207 may be printed on the fabric in the printable image area 206 of the cap 202 beginning just a centimeter above the bill 204.

The top plate 301 includes openings 309*a*, 309*b* which, when the top plate 301 closes onto the bottom plate 302, exposes at least a portion of the top surfaces 317*a*, 317*b* of each of the printing platens 307*a*, 307*b*. In an embodiment, the openings substantially conform to the shapes of the first and second printing platens 307*a*, 307*b* such that when the top plate 301 is closed over the bottom plate 302, the top surfaces 317*a*, 317*b* of the respective first and second printing platens 307*a*, 307*b* are entirely exposed through a respective opening 309*a*, 309*b* and preferably further such that the top surfaces 317*a*, 317*b* of the respective platens 307*a*, 307*b* are flush to the top surface 321 of the top plate 301.

In an embodiment, the size and shape of the pallet openings 309*a*, 309*b* in the top plate 301 conform substantially to the size and shape of the top surfaces 317*a*, 317*b* of the platens 307*a*, 307*b*. In an embodiment the sizes of the pallet openings 309*a*, 309*b* in the top plate 301 are just slightly larger than the footprints of their corresponding platen surfaces 317*a*, 317*b*. For example, in an embodiment the pallet openings 309*a*, 309*b* are only enough larger than the respective footprints of their corresponding platen surfaces 317*a*, 317*b* so as to accommodate the thickness of the cap fabric between the platens 307*a*, 307*b* and edges of the openings 309*a*, 309*b* when the top plate 301 is fully lowered over the bottom plate 302.

In an embodiment, the top plate 301 also includes one or more mechanisms for distributing compression at key surfaces of the fabric of the 3-dimensional object so as to stretch taut the targeted printing areas of the fabric over the platens 307*a*, 307*b*. Hereinafter, these mechanism(s) are called "compression distributors". The compression distributor(s) 305*a*, 305*b* are attached to the underside of the top plate 301 and positioned around and near the edge of the openings 309*a*, 309*b* so as to engage the fabric of the cap 202 and to pull the cap fabric flat towards the bottom plate 302 as the top plate 301 is lowered over the bottom plate 302 while the cap 202 is placed in proper position over the platens 307*a*, 307*b* with the bill resting on the bill support 308. When the top plate 301 is fully lowered over the bottom plate 302, the fabric corresponding to the printable image areas 206, 207 of the cap (e.g., front and back sides) are securely positioned, flat and taut, over the surfaces 317*a*, 3017*b* of the first and second platens 307*a*, 307*b*. In a preferred embodiment, the compression distributes 305*a*, 305*b* are positioned near and around the edges of the openings 309*a*, 309*b* on the underside of the top plate 301 so as to pull taut the fabric of cap 200 in all directions.

In an embodiment, at least one compression distributor 305*a* is positioned on the underside of the top plate 301 between the openings 309*a*, 309*b*. Placement of at least one compression distributor 305*a* between the platen openings 309*a*, 309*b* facilitates the pulling of the cap fabric from both the front and back sides of the hat to pull the top of the cap downward toward the bottom plate 301 while simultaneously flattening the printable image areas 206, 207 of the cap 202 over the top surfaces 317*a*, 317*b* of the respective platens 307*a*, 307*b*, as illustrated in FIGS. 4A-4D. In an embodiment, the depth of the compression distributor 305*a* (and/or alternatively compression distributors 305*b*) corresponds to the desired spacing between the top plate 301 and bottom plate 302 when the top plate 301 is closed over the bottom plate 302 and is ready for printing. In an embodiment, the depth of the compression distributors 305*a*, 305*b* is sufficient to pull the fabric in the area between the printable image areas 206, 207 down towards the bottom plate 301 until it is taut to thereby completely flatten the printing areas 206, 207 of the fabric over the surfaces 317*a*, 317*b* of the platens 207*a*, 207*b*, The depth of the compression distributors 305*a*, 305*b* will therefore depend on the height of the cap 202 (i.e., amount of fabric) between the front and back printable image areas 206, 207, as well as on the width and other dimensions of the distributors and bottom plate.

Figure 4A:
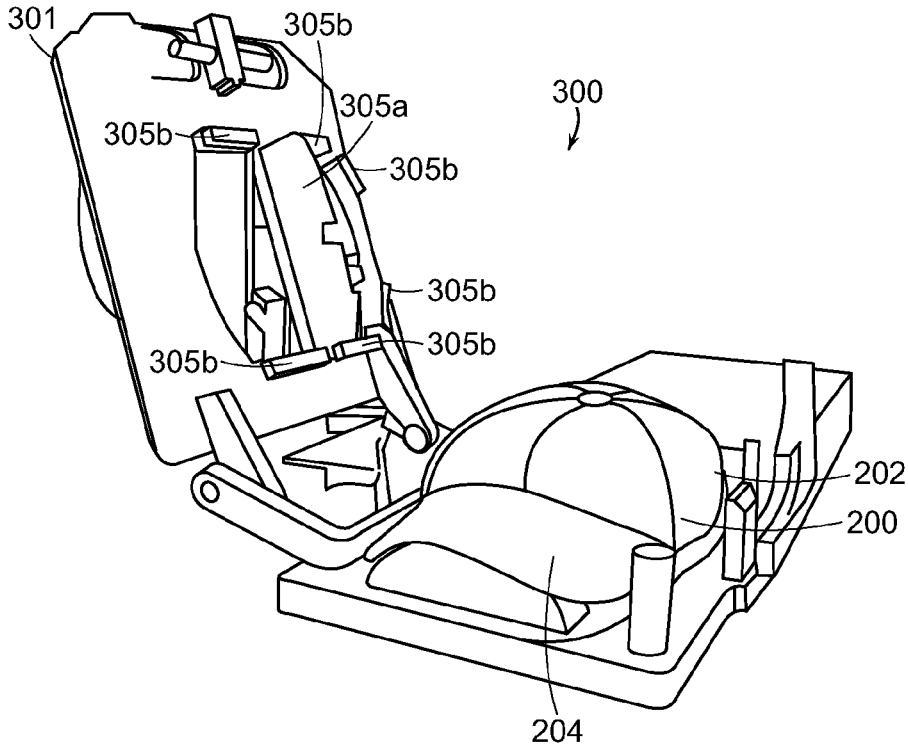
FIG. 4A is a perspective view of the hat pallet of FIGS. 3A-3B with the top plate open and the cap of a hat mounted over the printing plate and the bill of the hat mounted over the bill support.
Figure 4B:
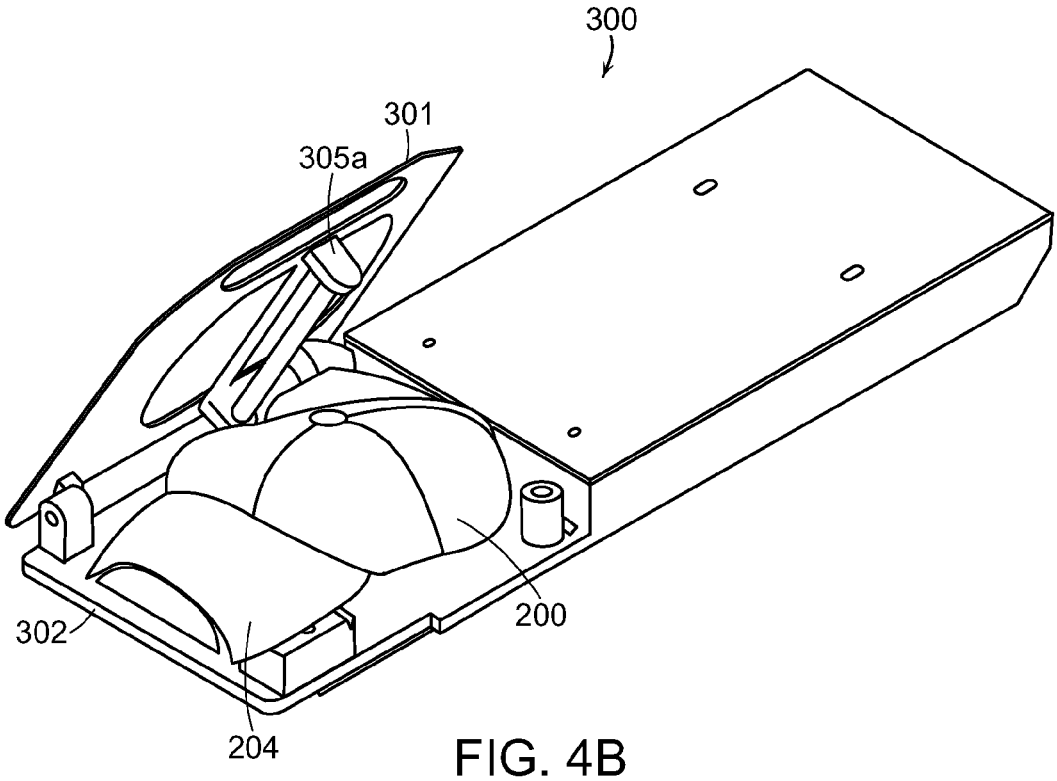
FIG. 4B is a perspective view of the hat pallet of FIGS. 3A-3B with the top plate being lowered over the bottom plate and illustrating the engagement of the compression distributor with the fabric of the top portion of the hat.

Referring to FIGS. 4A-4D, when a hat is mounted on the pallet 300 (see FIG. 4A), the compression distributor(s) 305 on the top plate 301 begin to engage the fabric of the cap 202 as the top plate 301 is closed over the bottom plate 302 (see FIG. 4B). As the top plate 301 is further closed, the fabric is pulled by the compression distributor(s) 310 so that when the top plate 301 is fully lowered over the bottom plate 302 (see FIG. 4C) the printable image areas 206, 208 of the fabric are positioned, flat and taut, and aligned over the respective first and second platens 307*a*, 307*b*. The close proximity of the edges of the openings relative the outer edges of the platens 307*a*, 307*b* serve to assist in automatically pulling taut the printable image areas 206, 208 of the cap 202, thereby assisting in reducing the time it takes to mount a hat in the pallet and align the targeted printable image areas 206, 208 in proper position on the surfaces 317*a*, 317*b* of the platens 307*a*, 307*b*.

The platens 307*a*, 307*b* may further comprise one or more alignment indicators. For example, in one embodiment, each platen 307*a*, 307*b* includes an inscribed line 315 or set of lines indicating where the center of the platen 307*a*, 307*b* is located. The line(s) 315 may, for example, align with the center seam of the front and back of the cap 202, and therefore may facilitate faster and more accurate loading of a hat in the pallet 300. Other lines or indicators may be implemented.

Preferably, the pallet 300 is manufactured to be as rust-proof as possible, as the printing, curing, and drying process can subject the pallet to moisture. For example, in an embodiment, the pallet is made completely of aluminum or other rust-free or low-rust material, and the hinges 303*a*, 303*b* may be fully enclosed. Furthermore, all mounting bolts may be made of stainless steel.

Figure 5A:
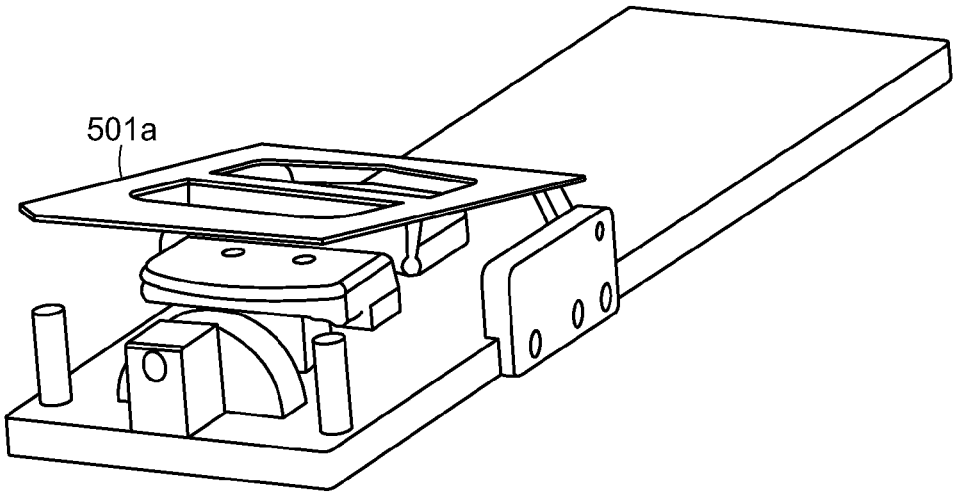
FIG. 5A is a perspective view of an alternative embodiment of a single-print-station hat pallet.
Figure 5B:
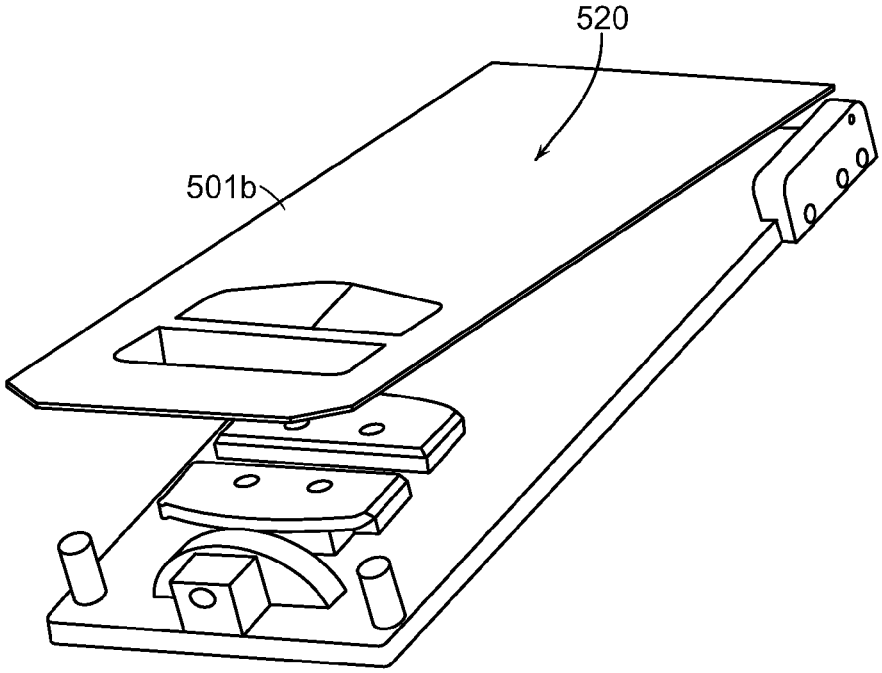
FIG. 5B is a perspective view of an additional alternative embodiment of a single-print-station hat pallet configured to also support printing of flat substrates such as paper.

Variations of the illustrated hat pallet 300 may be implemented without departing from the scope of the claimed invention. For example, the top plate may be hinged along a different side of the platens (e.g., in back (as illustrated at 501*a* in FIG. 5A and 501*b* in FIG. 5B), in front, along either side of the platens). The top plate may cover only as much of a surface area as is necessary to form a flat plane while exposing the top surfaces of the platens through its openings, as is illustrated in the embodiment of FIG. 5A. Alternatively, as shown in the embodiment of FIG. 5B, in addition to the area required to form the platen openings therein, the top plate may also include a contiguous flat top surface area 520 that is configured and sized large enough to fully support a flat substrate such as a sheet of paper at every point of the bottom surface of the flat substrate. This configuration may be utilized, for example, to allow printing onto paper without having to remove the hat pallet from the system and change it out with a paper pallet. This is especially useful, as discussed below, for use in performing intermittent nozzle tests to maintain the nozzles in order to achieve high color and print quality of the printed hats.

Additional variations, not shown, are also contemplated. For example, the bill support 308 may be a single block or multiple blocks, and/or may be hollow or made of a stiff (e.g. steel) netting or other material. In alternative embodiments, the platens 307*a*, 307*b*, may be a single platen having recessed areas for receiving one or more compression distributors. In other alternative embodiments, the platen(s) may be positioned in other arrangements and have other shapes to accommodate positions of targeted printing areas on other types of 3-dimensional apparel and other fabric products.

Figure 6A:
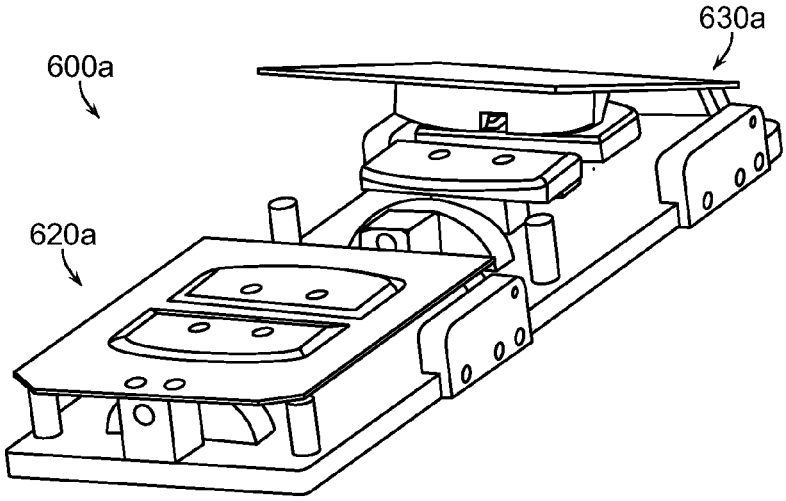
FIGS. 6A-6C are perspective views of alternative configurations of double-print-station hat pallets.
Figure 6B:
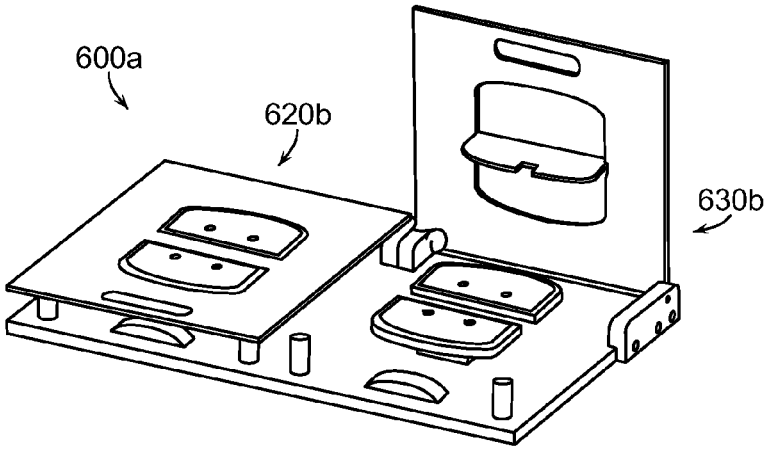
Figure 6C:
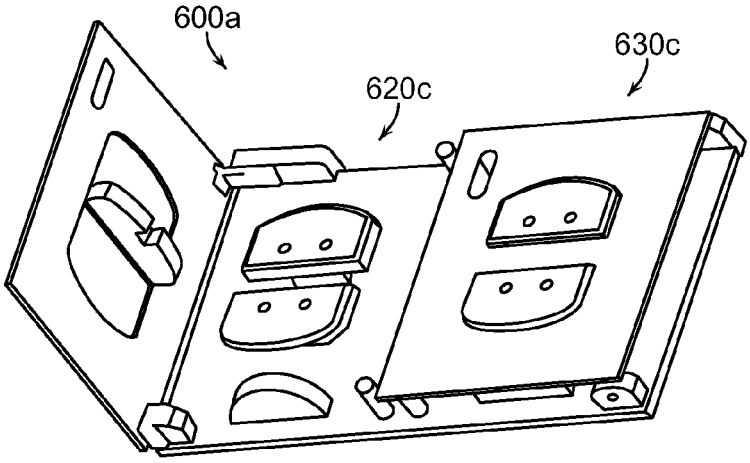

Furthermore, a pallet may be configured to support multiple hats or other 3-dimensional fabric pieces mounted thereon. For example, FIGS. 6A-6E illustrate multiple-hat-station pallets within the spirit of the invention. FIGS. 6A, 6B, and 6C show two-hat-station pallets for supporting two individual hats at respective hat stations. The configuration 600*a* shown in FIG. 6A provisions each hat station 620*a*, 630*a* with an independent top plate hinged at the back of each station, the stations located front to back. The configuration 600*b* shown in FIG. 6B provisions each hat station 620*b*, 630*b* with an independent top plate hinged at the back of each station, the stations located side by side. The configuration 600*c* shown in FIG. 6C locates the hat stations 620*c*, 630*c* side by side, and provisions each hat station with an independent top plate hinged at the respective left and right sides of the two station. Other configurations are also possible. For example, the top plates of each station may be configured integral to one another to form one larger top plate that serves as the top plate of both stations simultaneously.

Figure 6D:
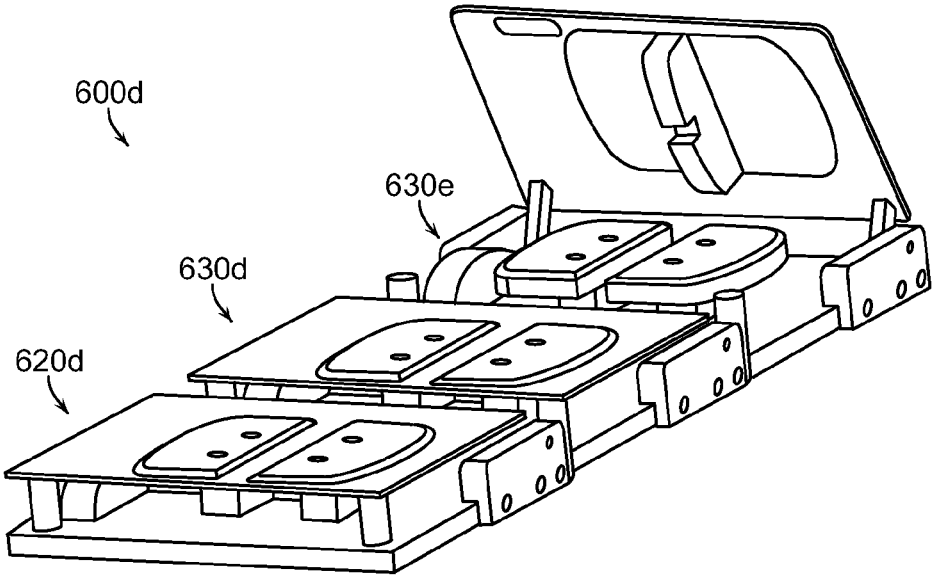
FIG. 6D is a perspective view of a triple-print-station hat pallet.
Figure 6E:
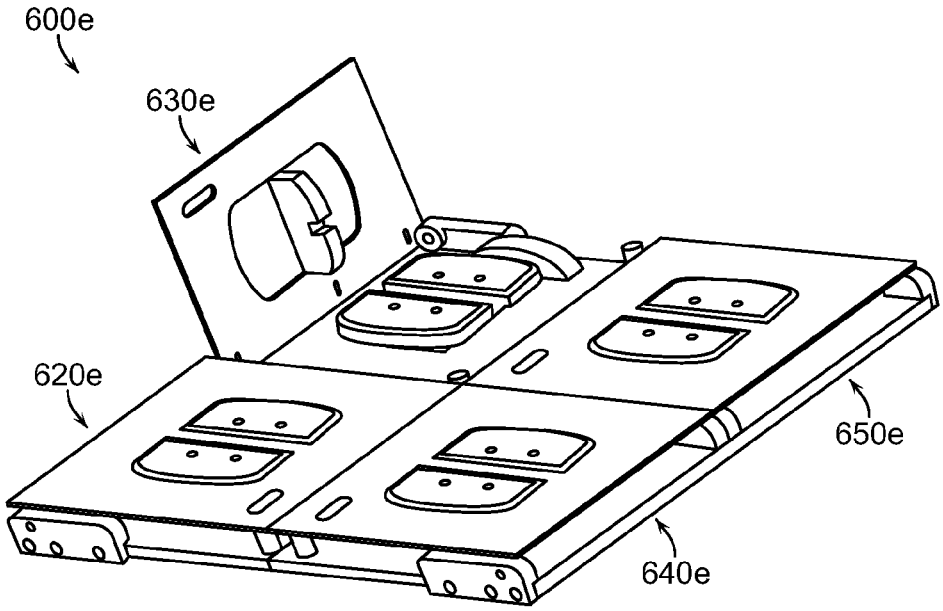
FIG. 6E is a perspective view of a quadruple-print-station hat pallet.
Figure 7A:
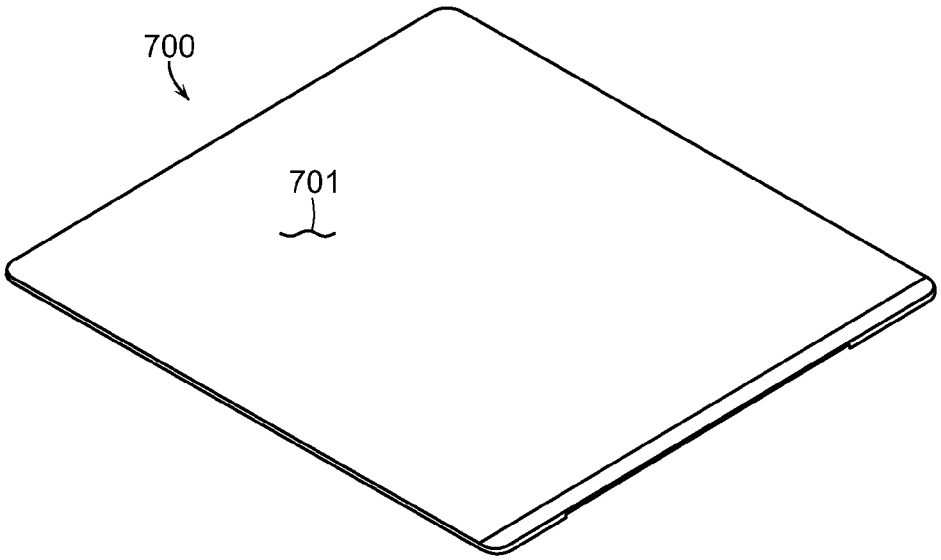
FIGS. 7A-7D illustrate a top isometric, a top-down, a side, and a bottom isometric view of an exemplary embodiment of a flat substrate print pallet adapter.
Figure 7B:
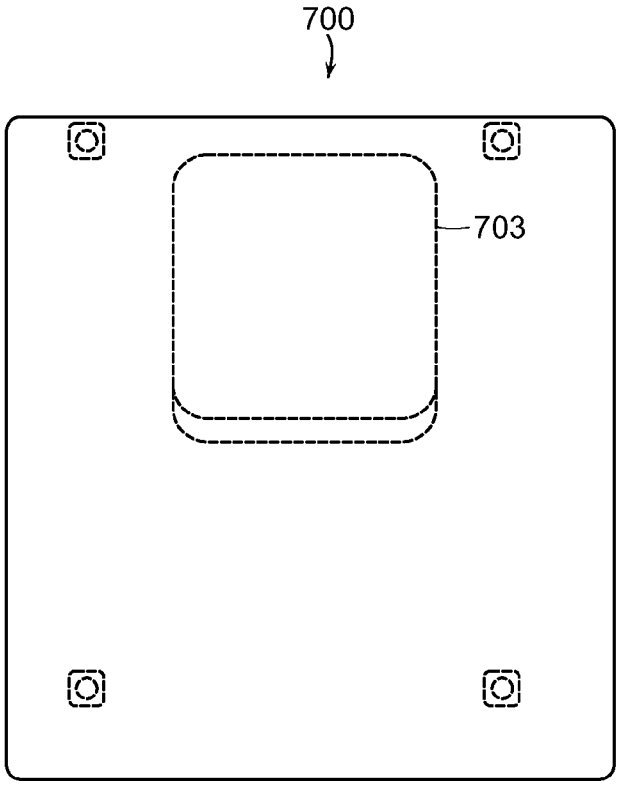
Figure 7C:
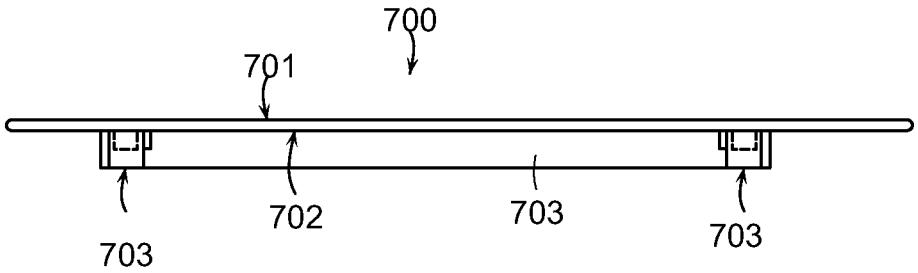
Figure 7D:
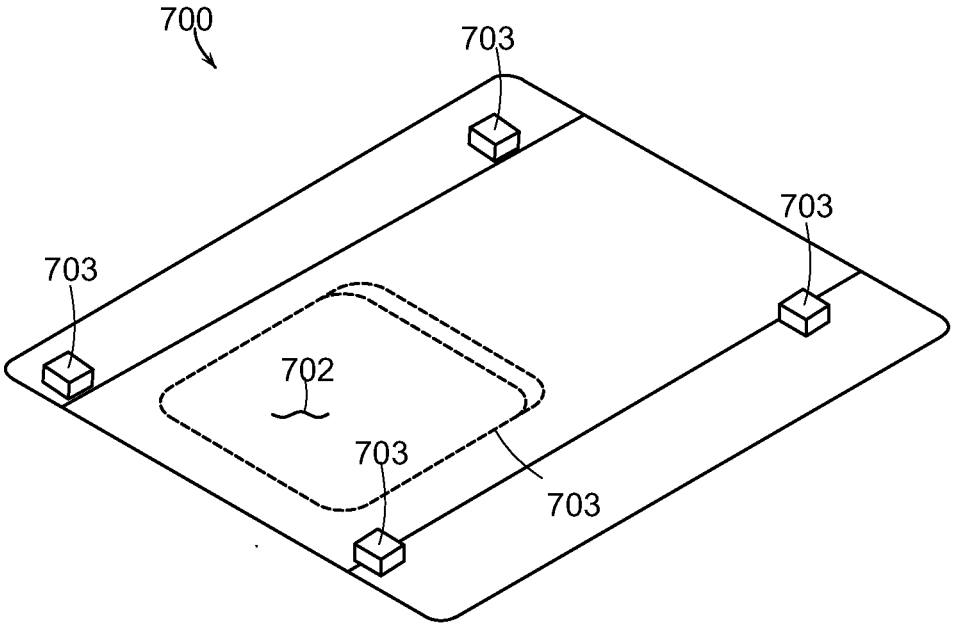

FIG. 6D illustrates an exemplary embodiment of a three-hat-station pallet 600*d*. As Shown, the pallet is provisioned with three hat stations 620*d*, 630*d*, 640*d*, located side by side on the bottom plate, with 3 independent top plates hinged along the side of each station. FIG. 6E illustrates an exemplary embodiment of a four-hat-station pallet 600*e* having four hat stations 620*e*, 630*e*, 640*e*, 650*e* mounted on the bottom plate and having independent top plates for each station. Again, other configurations are possible. Furthermore, the top plates of the hat stations may be combined into a single top plate that services all hat stations simultaneously.

Figure 10:
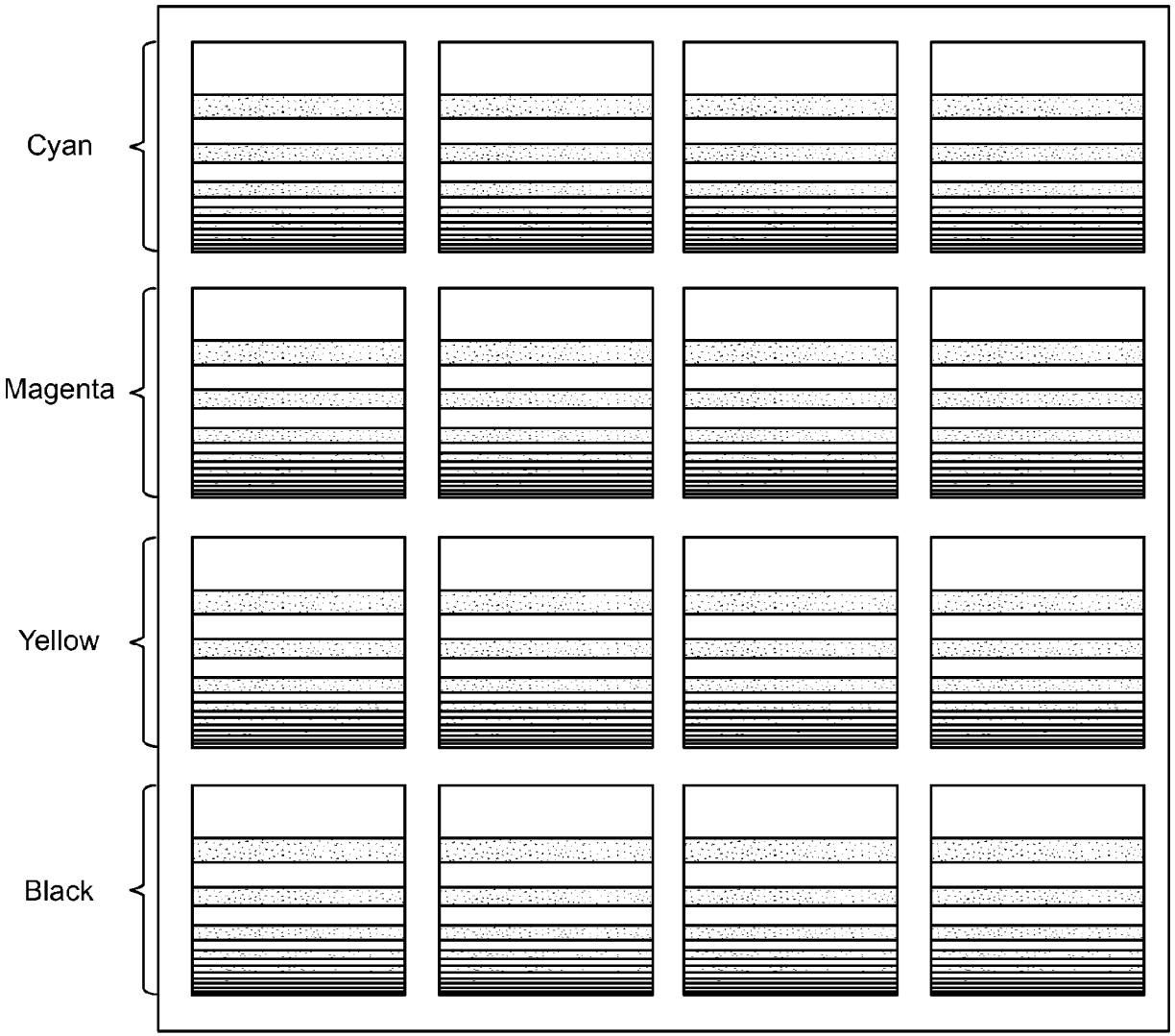
FIG. 10 is an exemplary sheet of paper containing the printed results of a nozzle maintenance test.

In order to ensure the print quality of images printed during the flat printing of multiple print jobs by a digital printing system such as the one shown in FIGS. 1A and 1B, printer maintenance is often performed. To this end, the nozzles 106 containing the ink are often put to the test to ensure that the ink flow rate is consistent. Because the ink itself has a high viscosity, the flow rate of each nozzle is slow to react to changes in demand for ink based on the image to be printed. In some cases, the nozzles 106 may become clogged, and the color consistency of the printed images may become less than desired. For these reasons, a nozzle maintenance test may be performed once every few hundred (or less or more) print jobs. A nozzle test typically involves the printing of each ink color alone in a series of pre-determined patterns (such as that shown in FIG. 10) that vary the demand for ink flow. For example, in an example nozzle test for a CMYK printing system, an image having differing width stripes of cyan, followed by differing width stripes of magenta, followed by differing width stripes of yellow, followed by differing width stripes of black may be printed. The printed image can indicate to the printer operator that one or more of the nozzles must be cleaned or ink replaced.

In a printing system that is designed to print flat surfaces, such as the printing system 100 described in relation to FIGS. 1A and 1B, a nozzle test is designed to be performed using a flat sheet of paper as the substrate. For example, the nozzle test pattern may cover an entire sheet of A3 paper.

When a pallet for printing multiple images onto 3-dimensional products is used such as the pallet described in relation to FIGS. 3A, 3B, 4A-4D, 5A, 5B, and 6A-6E, the surface of the top plate may is not be continuously flat at every point as needed to support a flat substrate. Even if the top surfaces 317*a*, 317*b* of the platens 307*a*, 307*b* are flush to the top surface of the top plate 301 when the pallet is in the closed position (i.e., the top plate 301 lowered over the bottom plate 302, there are still grooves (e.g., the space between the edges of the platens 307*a*, 307*b* and edges of the corresponding openings 317*a*, 317*b* that may not lead to a perfectly flat support surface for a piece of paper or other flat substrate. This may lead to inconsistent printing on the surface of the paper during a nozzle test. For this reason, the 3-dimensional object pallet may have to be removed and replaced with a flat pallet designed specifically for printing flat substrates (such as paper) when performing nozzle maintenance tests. However, removal of pallets from the printing system is a time-consuming process. Accordingly, it would also be desirable to include a pallet adapter that can be quickly attached to the 3-dimensional object pallet to convert it to a flat substrate pallet for use in nozzle maintenance tests.

Figure 8A:
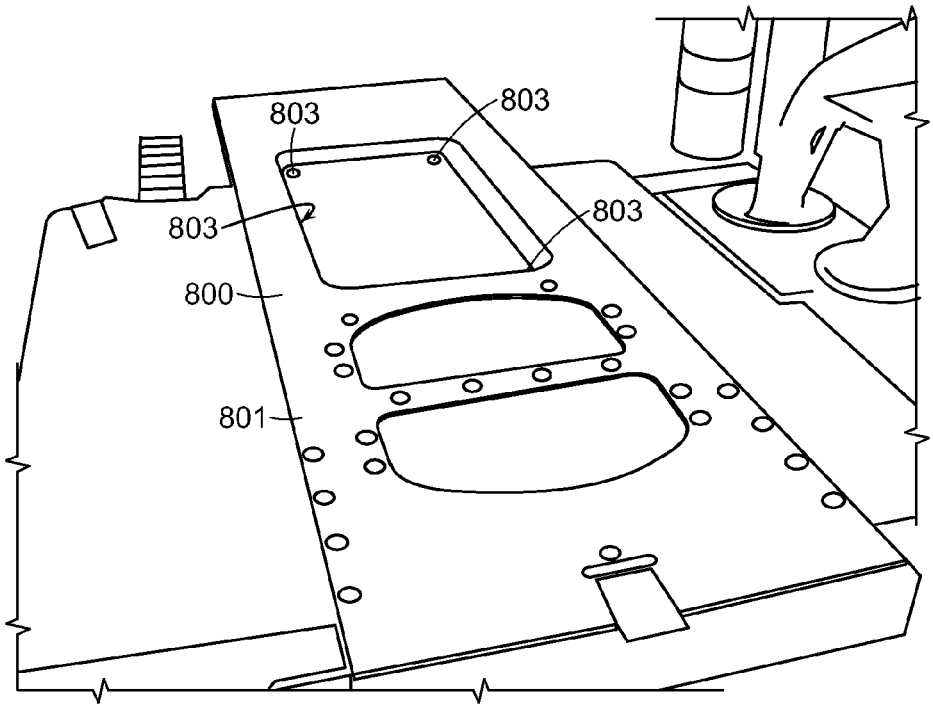
FIG. 8A is a perspective view of an exemplary single-print-station hat pallet prior to attachment of the flat-substrate print pallet adapter of FIGS. 7A-7D.
Figure 8B:
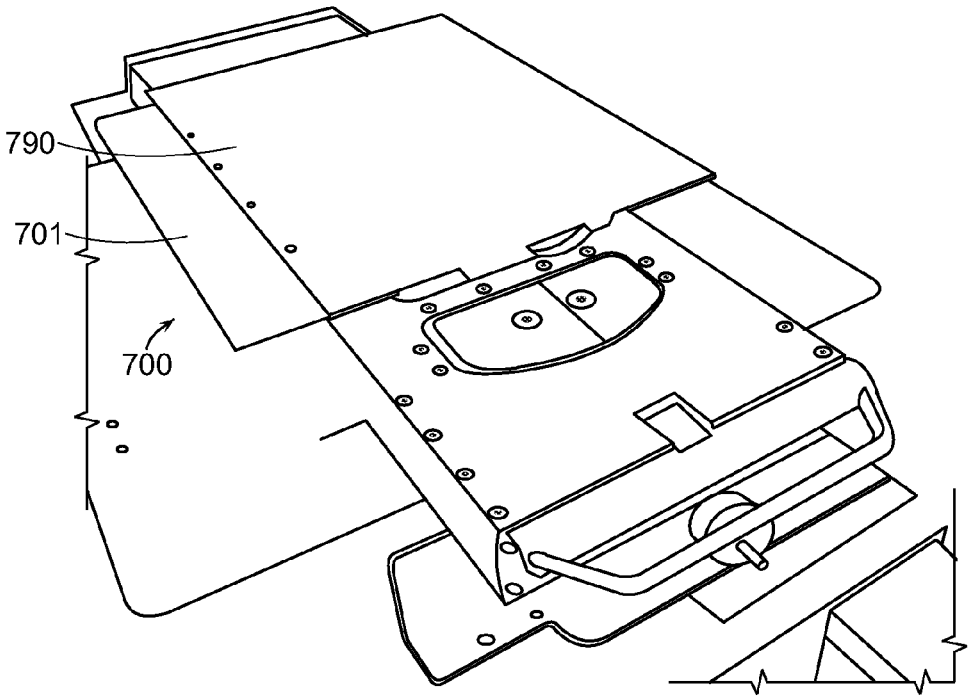
FIG. 8B is a perspective view of the single-print-station hat pallet after attachment of the flat-substrate print pallet adapter of FIGS. 7A-7D.

FIG. 7A-7D illustrate an exemplary flat substrate adapter 700 for the pallet 300 of FIGS. 3A and 3B. As illustrated, the flat substrate adapter has a continuously flat platen 701, herein referred to as a flat-substrate platen. In an embodiment, the bottom surface 702 of the adapter 700 includes one or more protruding members 703 positioned to mate to corresponding recesses in the top surface of the top and bottom plates of the pallet. When the flat substrate adapter is positioned over the top surface of the top plate 302 of the pallet 300 such that the protruding members 703 on the bottom surface of the flat substrate adapter are inserted in the corresponding recesses 803 of the top plate 801 of a pallet 800 such as the one illustrated in FIG. 8A, the flat substrate adapter 700 is fixed in position on the top surface of the pallet 800, as illustrated in FIG. 8B. The flat-substrate platen 701 of the adapter 700 is continuously flat and supportive in the printable area of a flat substrate mounted thereon. Thus, when a flat substrate such as a sheet of paper 790 is mounted on the top surface of the platen 701 of the adapter 700, the bottom surface of the flat substrate is fully supported at every point for printing.

Preferably, the fiat-substrate platen is configured with a contiguous flat surface area sized to accommodate at least a substrate having a size that corresponds to a maximum printable area of the printing system in which the pallet operates. In alternative embodiments, the flat-substrate platen is configured with a contiguous flat surface area sized to accommodate a substrate of a standard size, such as an 8½×11", A3, A4, or other size paper that corresponds to a standard sheet size typically accepted by and printable by the printing system.

In alternative embodiments, the flat substrate adapter may be attached using other attachment mechanisms. For example, the pallet may be configured with protruding members while the adapter is configured with correspondingly positioned recesses in its bottom surface. Alternatively, the adapter may be attached by spring pins, bolts, screws, clips, etc.

The top surface of the adapter 700 may be equipped with guides or indicators (such as lines inscribed on the surface) to ensure proper positioning of the paper on the printing surface.

Figure 9:
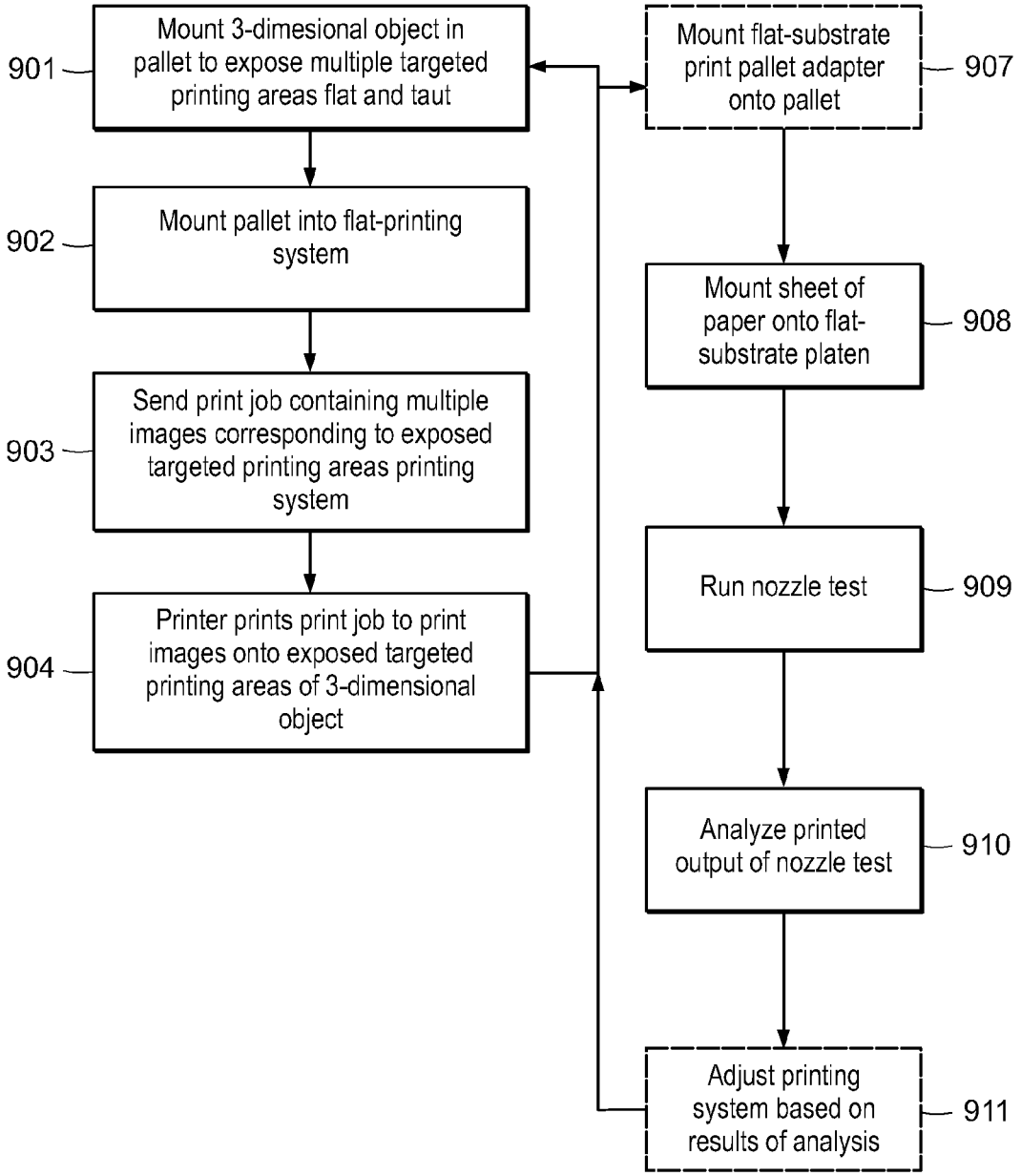
FIG. 9 is a flowchart illustrating a method of printing in accordance with an embodiment of the invention.

FIG. 9 illustrates an exemplary method for fiat printing on multiple image areas of a 3-dimensional object. In this method, a 3-dimensional object is mounted in a pallet to expose multiple targeted printing areas of the 3-dimensional object such that each exposed targeted printing area is flat and taut (step 901), The pallet is then mounted in a fiat-printing system (step 902). The flat-printing system receives a print job containing a plurality of images each corresponding to a different one of the exposed targeted printing area (step 903) and prints the respective plurality of images onto the corresponding exposed targeted printing areas of the 3-dimensional object mounted on the pallet (step 904).

For example, to print two sides of a hat in a single flat print job, for example using the printer 100 of FIGS. 1A, 1B, a hat is mounted on a pallet implemented according to the principles of the invention, for example a pallet implemented as in FIGS. 3A and 3B, and mounted as shown in FIG. 4A. Thus, the pallet preferably comprises a bottom plate 302 and a plurality of platens 307 for supporting the fabric corresponding to the printable image areas of the hat, each fixedly mounted on the bottom plate 302, a top plate 301 mountable over the bottom plate and having openings 309*a*, 309*b* corresponding to the platens 307*a*, 307*b* exposing the top surfaces of the platens 307*a*, 307*b* therethrough when the top plate 301 is lowered in position over the bottom plate 302.

Figure 4C:
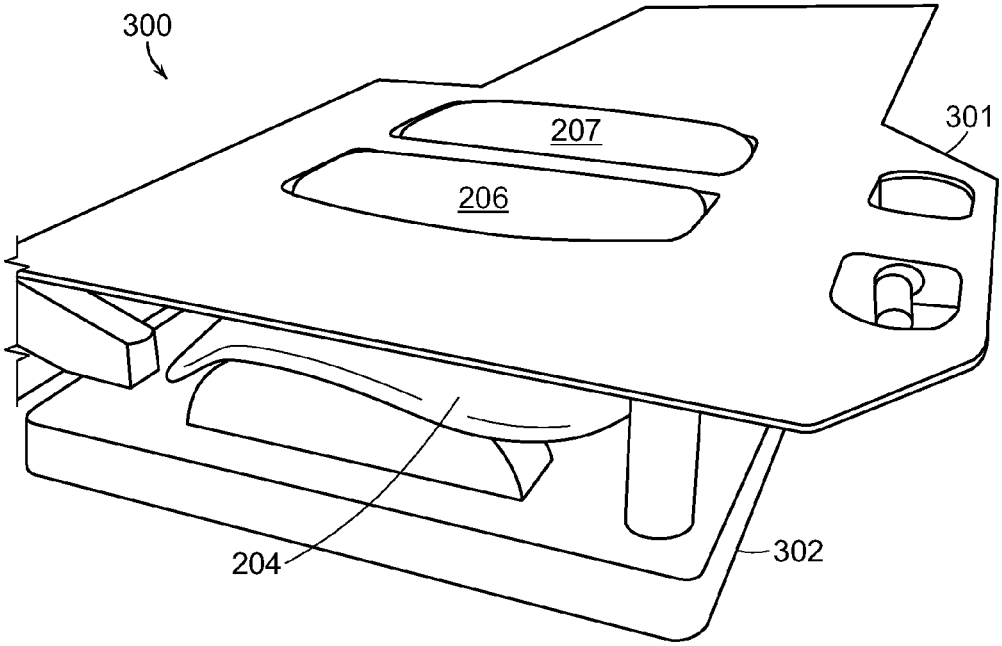
FIG. 4C is a perspective view of the hat pallet of FIGS. 3A-3B with a hat mounted in the pallet and the top plate in the closed position.
Figure 4D:
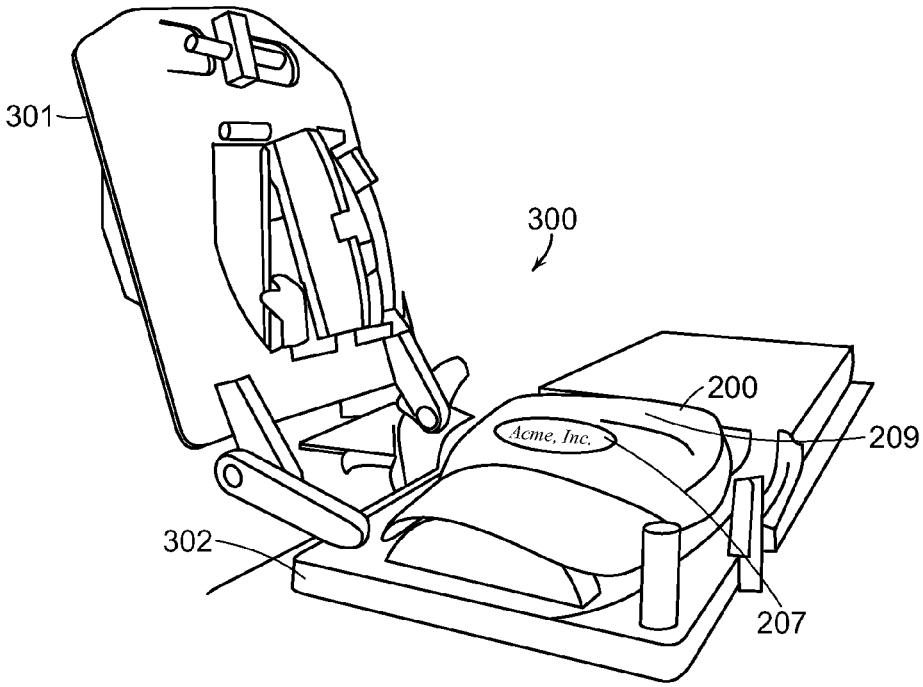
FIG. 4D is a perspective view of the hat pallet of FIGS. 3A-3B with the top plate open after a hat has been printed.

The top plate 301 is lowered over the bottom plate 302 wherein the compression distributor(s) 305 engage the fabric of the hat, as shown in FIG. 4B to pull the engaged fabric towards the bottom plate such that the fabric corresponding to the printable image areas 206, 207 is taut over the top surfaces 317*a*, 317*b* of the platens 307*a*, 307*b*, as shown in FIG. 4C. At this point, and as shown in FIG. 4C, the printable image areas 206, 207 on the cap are exposed through the openings 309*a*, 309*b* of the top plate 301 of the pallet 300, and the pallet is now loaded. The loaded pallet is then mounted on the conveyance system of the printing system 100, and a print job containing a single image file that includes both the front side image and back side image is sent to the printing system for printing both the front and back sides of the hat as a single print job. The printing system treats the pallet and cap fabric exposed through the top plate 301 of the pallet 300 as a single flat substrate to be printed. This allows the front and back side images to be aggregated into a single image to be printed such that the printer sees only a single image to be printed. The front and back side images are seen by the printing system merely as corresponding to different areas of a single image. Thus, the printer need not be instructed or altered in any manner to accommodate printing of multiple images onto a 3-dimensional substrate, yet such is still accomplished through the novel fabric flattening pallet described herein. Upon receipt of the print job, the printing system prints the file, resulting in the printing of both the front side image on the front printable area 206 and the back side image on the back printable area 207 of the cap. The top plate 301 is then raised, as shown in FIG. 4D, and the printed cap is removed from the pallet.

The process of FIG. 9 may be repeated to print additional 3-dimensional objects. Intermittently, a nozzle test may be performed. Without removing the 3-dimensional object pallet from the conveyance system of the printing system, a flat-substrate print pallet adapter such as that shown in FIGS. 7A-7D may be attached to the pallet, as described above and as indicated in FIGS. 8A-8B (step 907). Alternatively, the 3-dimensional object pallet already includes a flat-substrate platen formed integral to the pallet itself, for example as illustrated in FIG. 5B. A sheet of paper is placed in proper printing position on the flat-substrate platen (step 908). A nozzle test is then performed, which prints out a test pattern onto the sheet of paper mounted on the flat-substrate platen (step 909). The printed output is then analyzed and, potentially, adjustments are made to the nozzles/ink/printing system based on results of the analysis (step 910). The process(es) may then be repeated as needed.

While an exemplary embodiment of the invention has been discussed, the described embodiment is to be considered as illustrative rather than restrictive. The scope of the invention is as indicated in the following claims and all equivalent methods and systems.

What is claimed is:

1. A pallet for holding a 3-dimensional object for printing onto a plurality of target image areas on a 3-dimensional object, the target image areas on a flexible substrate of the 3-dimensional object, the pallet comprising:

a bottom plate;

at least one print station, each print station comprising a plurality of platens mounted on the bottom plate, the plurality of platens having respective flat top surfaces and positioned to support the target print areas of the 3-dimensional object when the 3-dimensional object is properly positioned in the pallet, a top plate movable between an open position and a closed position, the top plate comprising a plurality of openings positioned to expose at least a portion of each of the flat top surfaces of the plurality of platens when the top plate is in the closed position and the pallet is empty, and to expose the target image areas of the flexible substrate of the 3-dimensional object when the 3-dimensional object is properly positioned in the pallet and the top plate is moved into the closed position, and one or more compression distributors attached to the top plate and positioned between two or more of the top plate openings to engage the flexible substrate of the 3-dimensional object and to simultaneously pull portions of the engaged flexible substrate positioned over each of the platens corresponding to the two or more top plate openings towards the bottom plate as the top plate is moved from the open position and lowered onto the bottom plate to the closed position to thereby pull taut the portions of the flexible substrate corresponding to the plurality of target image areas over the plurality of platens.

2. The pallet of claim 1, wherein the openings in the top plate comprise edges that engage and pull the flexible substrate towards the bottom plate as the top plate is moved from the open position to the closed position.

3. The pallet of claim 1, the 3-dimensional object comprising a hat configured with a cap having a front side and back side and a bill attached at the front side of the cap, each print station further comprising:

a bill support mounted on the bottom plate; wherein the bill support is positioned such that when the hat is mounted in the pallet with the bill over the bill support and the cap over the plurality of platens and the top plate is lowered over the bottom plate into the closed position, a target image area on the front side of the cap is supported on one of the plurality of platens and exposed through an opening in the top plate, a target image area on the back side of the cap is supported on a different one of the plurality of platens and exposed through another opening on the top plate, and the bill of the hat is supported by the bill support.

4. The pallet of claim 3, wherein the bill support supports the hat such that the bill and portion of the cap above the bill lie along a horizontal plane when the hat is mounted in the pallet with the top plate in the closed position.

5. The pallet of claim 1, wherein the 3-dimensional object comprises a hat configured with a cap having a front side and a back side, and further wherein a first target image area is located on the front side of the cap and a second target image area is located on the back side of the cap, and the plurality of platens comprises a first platen positioned to support the front side of the cap along a flat plane and a second platen positioned to support the back side of the cap along the flat plane when the hat is properly positioned in the pallet with the cap over the first and second platens and the top plate is lowered over the bottom plate into the closed position.

6. The pallet of claim 5, wherein the top plate comprises a first opening positioned to expose the top surface of the first platen and a second opening positioned to expose the top surface of the second platen.

7. The pallet of claim 6, wherein at least one compression distributor is positioned between the first opening and the second opening on the underside of the top plate so as to engage the flexible substrate of the hat between the front side and back side of the hat and to pull it towards the bottom plate as the top plate is lowered over the bottom plate into the closed position.

8. The pallet of claim 1 comprising a plurality of print stations.

9. The pallet of claim 8, comprising a single top plate integrally forming each of the respective top plates of each of the plurality of print stations.

10. The pallet of claim 1, wherein the top plate further comprises a flat-substrate platen having a contiguous flat surface area sized to accommodate at least a flat substrate having a size that corresponds to a maximum printable area of a printing system in which the pallet operates.

11. The pallet of claim 10, wherein the flat substrate is paper is sized large enough to print output from a nozzle test.

12. The pallet of claim 1, further comprising a removable flat plate which attaches to the top plate and is configured with a flat-substrate platen having a contiguous flat surface area sized to accommodate at least a flat substrate having a size that corresponds to a maximum printable area of a printing system in which the pallet operates.

13. The pallet of claim 12, wherein the flat substrate is paper is sized large enough to print output from a nozzle test.

14. The pallet of claim 1, further comprising at least one alignment guide on at least one of the platens.

* * * * *